US005153965A

United States Patent [19]

Prosser et al.

[11] Patent Number: 5,153,965

[45] Date of Patent: Oct. 13, 1992

[54] VACUUM CLEANER WITH DISPOSABLE FILTER, HOSE AND NOZZLE

[76] Inventors: Richard W. Prosser, 2116 Camelot Dr., Parma, Ohio 44134; Ronald J. Seink, 20406 Scott Dr., Strongsville, Ohio 44136

[21] Appl. No.: 660,737

[22] Filed: Feb. 25, 1991

[51] Int. Cl.[5] ..... A47L 5/36

[52] U.S. Cl. ..... 15/327.1; 15/339; 15/347; 15/352

[58] Field of Search ..... 15/327.1, 344, 350, 15/352, 347, 339

[56] References Cited

U.S. PATENT DOCUMENTS 2,354,089 7/1944 Replogle ..... 15/339 X 4,613,348 9/1986 Natale ..... 15/347 X 4,833,753 5/1989 Müller ..... 15/347 X

*Primary Examiner*—Chris K. Moore

*Attorney, Agent, or Firm*—Renner, Kenner, Greive, Bobak, Taylor & Weber

[57] ABSTRACT

A vacuum cleaner is provided with filters external to the housing receiving the fan and motor assemblies. A filter, hose and nozzle of the vacuum cleaner are provided as disposable items and serve the function of receiving and retaining debris. A hose is connected at one end thereof to a filter and at another end to a nozzle, the nozzle being configured to also be received by the filter to define a substantially closed container for disposal purposes.

15 Claims, 1 Drawing Sheet

VACUUM CLEANER WITH DISPOSABLE FILTER, HOSE AND NOZZLE

TECHNICAL FIELD

The invention herein resides in the art of vacuum cleaning devices and, more particularly, to a vacuum cleaner specifically adapted for cleaning residue and debris from medical equipment. The invention presents a vacuum cleaner in which an interconnected nozzle, hose, and filter assembly are disposably connected to a vacuum motor housing.

BACKGROUND ART

In the medical field of histology, tumors and other tissues surgically removed from patients are analyzed for the presence of disease. As a part of such analysis, typically referred to as a biopsy, the tumors and tissues are often processed in a cryostat or similar tissue cutter where small slices of the tissue or tumor are prepared for microscopic view or other appropriate tests.

As a consequence of the process of preparing the tissue or tumor for analysis, debris must be cleaned from the tissue cutter on a regular basis. Such debris typically consists of body parts and/or encapsulating material as is commonly employed in the medical field. In the prior art, alcohol baths and hand swabbing of such tissue cutters was the norm for the cleaning process. However, such a technique is somewhat dangerous since the interior of the tissue cutter, which must necessarily be accessed during the cleaning process, is characterized by a number of sharp edges and blades necessary for achieving the desired tissue slicing. It will be readily apparent that, with the tissue cutter containing body parts which may carry communicable diseases, the possibility that personnel may be cut during the cleaning process subjects such personnel to unnecessary health risks. Accordingly, it is most preferable that tissue cutters such as cryostats be cleaned without the necessity of the cleaning personnel presenting their hands within the device.

Another problem incident to the cleaning of tissue cutters is the method of disposal of the collected debris. Another problem relates to the necessity to clean the equipment used in cleaning the tissue cutter. Heretofore, no special apparatus or techniques have been devised or employed for cleaning such tissue cutters after use.

Applicants have found that a vacuum cleaner of special configuration can be employed for the desired purpose. However, vacuum cleaners of the type presented below have not been previously known. In the prior art, it has been taught by U.S. Pat. No. 3,015,122 that a bag filter may be placed within the wand of a vacuum cleaner to supplement a collection bag within the canister of the cleaner itself. Further, U.S. Pat. No. 3,039,122 has taught the implementation of a debris trap between a cleaning nozzle and a suction hose. Similarly, U.S. Pat. No. 3,310,173 has taught the implementation of a filter cartridge in communication with the wand of a swimming pool cleaning device, adapted for seizing and retaining large particulate matter in a manner similar to U.S. Pat. No. 3,039,122.

The prior art appears to be devoid of a vacuum clean in which the filter, hose, and nozzle serve as the debris collection device, and which comprise disposable units. Additionally, the prior art is devoid of a vacuum cleaner in which the fan and motor housing contain no filters, but in which the filtering system is maintained solely within the hose and/or wand assembly, precluding the possibility of any dirt, debris, or moisture from reaching the fan and motor.

DISCLOSURE OF INVENTION

In light of the foregoing, it is an aspect of the invention to provide a vacuum cleaner in which the fan and motor are housed separate from the debris collection elements.

Another aspect of the invention is the provision of a vacuum cleaner in which the hose provides the debris collection and retention function.

Still a further aspect of the invention is the provision of a vacuum cleaner in which the hose, nozzle, and filter elements are disposable.

An additional aspect of the invention is the provision of a vacuum cleaner which is reliable and durable in use, while being easy to implement with state-of-the-art elements.

The foregoing and other aspects of the invention which will become apparent as the detailed description proceeds are achieved by a vacuum cleaner, comprising: a vacuum source; a hose interposed between said vacuum source and said nozzle; and a first filter interposed between said vacuum source and said nozzle.

Other aspects of the invention are attained by the improvement in a vacuum cleaner having a vacuum motor and fan received within a housing, comprising: a hose in operative communication with the housing; a nozzle in a first end of said hose; and a first filter in operative communication with said hose and external to said housing.

Still additional aspects of the invention are attained by a vacuum cleaner, comprising: a housing receiving a vacuum motor; and a hose extending from said housing; a nozzle connected to a first end of said hose; and a first filter interposed between said housing and a second end of said hose.

DESCRIPTION OF DRAWING

For a complete understanding of the objects, techniques and structure of the invention reference should be made to following detailed description and accompanying drawing wherein.

BEST MODE FOR CARRYING OUT THE INVENTION

Figure 1:
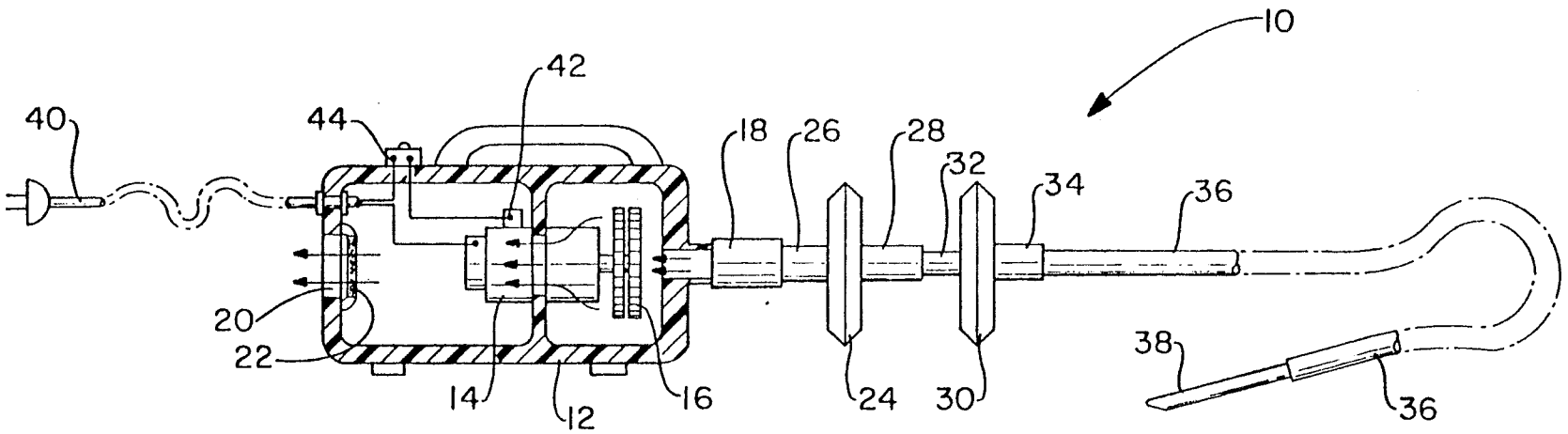
FIG. 1 is an illustrative view of a vacuum cleaner made according to the invention.

Referring now to the drawing and more particularly FIG. 1, it can be seen that a vacuum cleaner made according to the invention is designated generally by the numeral 10. The vacuum cleaner 10 incorporates a housing 12 defining an inner chamber which receives a motor 14 operative to drive a fan 16. The motor 14 is appropriately mounted in the housing 12 and, in conjunction with the fan 16, is operative for generating a vacuum therein. It will be readily appreciated by those skilled in the art that the motor 14 and fan 16 may be separate elements, or may be combined in what is traditionally known in the art as a vacuum motor.

An inlet coupling 18 extends from a front wall of the housing 12 to communicate with the chamber defined thereby. In like manner, an exhaust opening or port 20 is positioned in a wall opposite that of the inlet coupling 18 to exhaust air drawn into the housing by the motor 14 and fan 16 through the inlet coupling 18. In a preferred embodiment of the invention, the exhaust port 20 is covered by an appropriate diffuser and/or filter assembly 22. Most preferably, the filter comprises a bacterial filter for purposes of optimally achieving the objects of the invention.

Connected to the inlet coupling 18 is a filter 24 which, in the preferred embodiment of the invention, is a 1 micron viral bacterial filter of the type typically used in breathing machines employed for respiratory therapy. Those skilled in the art will readily appreciate that the filter 24 will trap debris having a minimum width or diameter greater than 1 micron and will also serve to inhibit the passage of moisture. The filter 24 is provided with an outlet coupling 26 which is received within the inlet coupling 18 of the housing 12. The filter 24 also has an inlet coupling 28 which is adapted to mate with the filter 30 as shown. In a preferred embodiment of the invention, the filter 30 is substantially identical to the filter 24, being a 1 micron viral bacterial filter of the type used in breathing machines. The filter 30 has an outlet coupling 32 which is received within the inlet coupling 28 of the filter 24.

A flexible hose 36 is received within and extends from an inlet coupling 34 of the filter 30. An appropriate tubular nozzle or crevice tool 38 is received within an end of the hose 36 as shown. For purposes which will become apparent hereinafter, the outer diameter of the nozzle 38 is slightly less than the inner diameter of the coupling 32 of the filter 30 so that the nozzle 38 can be frictionally and slidingly received therein.

In operation, the motor 14 is actuated such that the fan 16 generates a vacuum within the housing 12. This vacuum is evidenced at the end of the nozzle 38 which is then placed within the tissue cutter of the cryostat for purposes of picking up debris such as body parts and encapsulating material. This debris passes along the flexible hose 36 to the filter 30 where it is stopped. The second filter 24, downstream from the filter 30 in the airflow path, provides a safety factor for any debris which might pass the filter 30. It is comtemplated that the filter 24 could be of a finer mesh than filter 30, stopping those particles of material which might pass through the filter 30.

Figure 2:
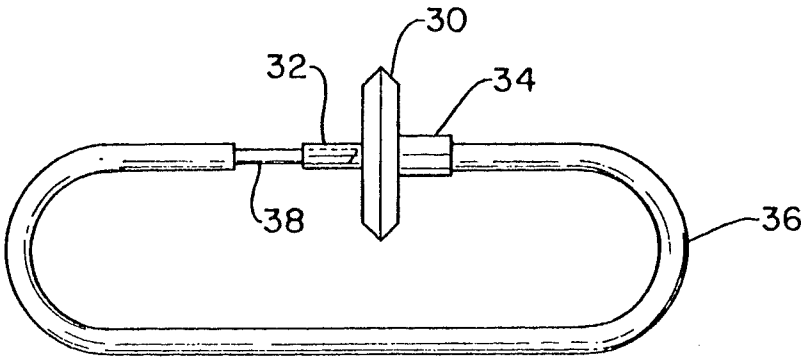
FIG. 2 is a front perspective view of the hose, nozzle and filter assembly of the invention shown in its posture for disposal.

Once the vacuum cleaner 10 has completed its task of cleaning the tissue cutter, the outlet coupling 32 of the filter 30 is disengaged from the inlet coupling 28 of the filter 24. The hose 36 is then curved so that the nozzle 38 is aligned with the outlet coupling 32, allowing the nozzle 38 to be received therein. Accordingly, and as shown in FIG. 2, all of the debris extracted from the tissue cutter is retained within the assembly of the filter 30, hose 36, and nozzle 38 which, at this time, comprises a substantially sealed unit. This unit may be readily discarded and replaced with a new filter 30, hose 36, and nozzle 38 in the vacuum cleaner 10. While it is contemplated that the elements of FIG. 2 are to be replaced after each use of the vacuum cleaner 10, it is also contemplated that the secondary filter 24 may be replaced on a less frequent basis, such as monthly, or after a given number of uses.

With continued reference to FIG. 1, it can be seen that the motor 14 is interconnected with an electrical cord 40 for connection with an appropriate power source. A thermal cut-out switch 42 is interconnected with the motor 14 and to one of the power lines of the cord 40. In the event that the motor 14 overheats, as might be caused by "blinding" or clogging of one of the filters 24, 30, the thermal cut-out switch 42 will terminate operation of the motor 14. A reset button 44 is provided to reset the thermal cut-out 42 and allow operation to continue once the problem causing the overheating has been corrected. Again, it is contemplated that the most likely cause of overheating will be blinding of the filters.

It will be appreciated by those skilled in the art that a principal benefit of the invention is the disposability of the hose, filter, and nozzle subassembly as shown in FIG. 2. It is further most beneficial that the motor 14 and fan 16 are isolated from any debris receiving or containing functions. Additionally, the chamber of the housing 12 is protected from moisture and the like by the nature of the filters 24, 30. Those skilled in the art will further readily appreciate that any appropriate vacuum source, such as a centralized vacuum source or the like might be employed in accordance with the teachings of the invention.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention, reference should be made to the following claims.

What is claimed is:

1. A vacuum cleaner, comprising:

a vacuum source;

a nozzle;

a hose interposed between said vacuum source and said nozzle;

a first filter interposed between said vacuum source and said nozzle; and wherein said hose, nozzle, and first filter are disposable, said first filter having an inlet coupling receiving said hose, and an outlet coupling for connection to said vacuum source and adapted for receiving said nozzle when said filter is detached from said vacuum source.

2. The vacuum cleaner according to claim 1, wherein said first filter is interposed between said hose and said vacuum source.

3. The vacuum cleaner according to claim 1, further comprising a second filter interposed between said vacuum source and first filter.

4. The vacuum cleaner according to claim 3, wherein said first and second filters comprise bacterial filters.

5. The vacuum cleaner according to claim 3, wherein said vacuum source comprises a motor and fan within a housing, said housing having an exhaust port covered by a third bacterial filter.

6. The vacuum cleaner according to claim 5, futher comprising a thermal cut-out operatively connected to said motor for inhibiting operation of said motor in the event the temperature of said motor exceeds a threshold.

7. In a vacuum cleaner having a vacuum motor and fan received within a housing, the improvement comprising:

a hose in operative communication with the housing;

a nozzle at a first end of said hose; and a first filter in operative communication with said hose and external to said housing, said first filter having an inlet coupling connected to a second end of said hose, and an outlet coupling for communicating with said housing, and adapted to receive said nozzle when said filter is detached from said housing, said first filter, hose, and nozzle being disposable.

8. The improvement in a vacuum cleaner according to claim 7, further comprising a second filter interposed between said first filter and said housing.

9. The improvement in a vacuum cleaner according to claim 8, wherein said first and second filters are bacterial filters passing only particulate matter less than 1 micron in diameter.

10. The improvement in a vacuum cleaner according to claim 9, further comprising means connected to the motor for inhibiting operation of the motor in the event the temperature of the motor exceeds a set level.

11. The improvement in a vacuum cleaner according to claim 8, further comprising an exhaust port within the housing, said exhaust port being covered with a third filter.

12. A vacuum cleaner, comprising:

a housing receiving a vacuum motor;

a hose;

a nozzle connected to a first end of said hose; and a first filter interposed between said housing and a second end of said hose, and first filter being adapted to receive said nozzle when detached from said housing.

13. The vacuum cleaner according to claim 12, further comprising a second filter interconnected between said first filter and said housing.

14. The vacuum cleaner according to claim 13, wherein said nozzle comprises a tubular crevice tool.

15. The vacuum cleaner according to claim 14, wherein said housing is devoid of a filter in an airflow between said hose and said motor.

* * * * *